US007665628B1

(12) United States Patent
Milligan

(10) Patent No.: US 7,665,628 B1
(45) Date of Patent: Feb. 23, 2010

(54) TISSUE BOX COVER

(76) Inventor: Loren Milligan, P.O. Box 157, Baxter, IA (US) 50028

( * ) Notice: Subject to any disclaimer, the term of this patent is extended or adjusted under 35 U.S.C. 154(b) by 2 days.

(21) Appl. No.: 12/179,473

(22) Filed: Jul. 24, 2008

(51) Int. Cl.
*B65H 1/12* (2006.01)

(52) U.S. Cl. ..... 221/59; 221/213; 221/287

(58) Field of Classification Search ..... 221/1–312 C
See application file for complete search history.

(56) References Cited

U.S. PATENT DOCUMENTS 2,636,599 A * 4/1953 Willis et al. ..... 221/48
3,343,716 A * 9/1967 Peebles ..... 221/46
3,685,777 A * 8/1972 Dema ..... 248/205.1
3,801,056 A * 4/1974 Brody ..... 248/205.1
3,982,717 A * 9/1976 Pavelle et al. ..... 248/313
4,896,773 A * 1/1990 Zilio ..... 206/494
7,273,156 B2 * 9/2007 Gao et al. ..... 221/47
2009/0134296 A1 * 5/2009 Odishoo ..... 248/231.91

* cited by examiner

*Primary Examiner*—Gene Crawford
*Assistant Examiner*—Michael K Collins
(74) *Attorney, Agent, or Firm*—Schmeiser, Olsen & Watts LLP

(57) ABSTRACT

A tissue box cover with an integral tissue lifting device is provided. The tissue box includes a bottom portion having a base and four side members defining an opening for receiving a tissue box. The base has a lifting device. The lifting device includes a plurality of piercing members coupled to the base, the piercing members adapted to puncture a hole in a bottom surface of the tissue box. The lifting device further includes a plurality of lifting members corresponding to the plurality of piercing members, each of the plurality of lifting members having a resilient member that biases tissues within the tissue box toward a top surface of the tissue box. The tissue box cover also includes a top portion adapted to repeatably, removably couple to the bottom portion of the tissue box.

12 Claims, 5 Drawing Sheets

TISSUE BOX COVER

BACKGROUND OF THE INVENTION

1. Technical Field

This invention relates generally to a tissue box cover and more particularly to a tissue box cover with a lifting device.

2. State of the Art

The use of tissue box covers are most often used for decorative purposes for creating a cover that functions as a design element and hides the function tissue box. The use of tissue box covers is common among many households. Not only do they provide a design aspect to tissues, but they often times serve to protect the tissue box from damage.

These conventional tissue box covers have their limitations, and more particularly tissue box covers that are formed of rigid material. Access to the tissues is provided by use of an aperture that extends through a top portion of the cover and allows a user to reach his or her hand into the box cover and pull tissues from the tissue box. This task becomes increasingly difficult the lower the level of tissue in the tissue box drops. The tissue box cover at this point becomes a hindrance to the user in obtaining a tissue from the tissue box.

Accordingly, there is a need in the field of tissue box covers for an improved tissue box cover with a lifting device for lifting tissue within the tissue box.

DISCLOSURE OF THE INVENTION

The tissue box cover with a lifting device of this invention has several features, no single one of which is solely responsible for its desirable attributes. Without limiting the scope of this invention as expressed by the claims that follow, its more prominent features will now be discussed briefly. The present invention relates to a tissue box cover with a lifting devices adapted to lift tissue within a tissue box. Generally, the present invention includes a tissue box cover having a top and bottom portion and a lifting device having piercing members and lifting members.

An aspect of the present invention includes a lifting device for use in a tissue box cover for lifting tissues in a tissue box. The lifting device comprises a base and a plurality of piercing members coupled to the base. The piercing members adapted to puncture a hole in a bottom surface of a tissue box. The lifting device may further comprise a plurality of lifting members corresponding to the plurality of piercing members. Each of the plurality of lifting members may have a resilient member that biases tissues within the tissue box toward a top surface of the tissue box.

Another aspect of the present invention includes a tissue box cover with an integral tissue lifting device. The tissue box comprises a bottom portion having a base and four side members defining an opening for receiving a tissue box, the base having a lifting device. The lifting device comprises a plurality of piercing members coupled to the base, the piercing members adapted to puncture a hole in a bottom surface of the tissue box; and a plurality of lifting members corresponding to the plurality of piercing members, each of the plurality of lifting members having a resilient member that biases tissues within the tissue box toward a top surface of the tissue box. The tissue box may further comprise a top portion adapted to repeatably, removably couple to the bottom portion of the tissue box.

Yet another aspect of the present invention includes a method of using a tissue box cover with a lifting device. The method comprises the steps of placing a tissue box within a bottom portion of the tissue box cover, wherein the tissue box is adjacent a piercing members of a lifting device coupled to a base of the tissue box cover; placing a top portion of the tissue box cover over the tissue box; applying force in the direction of the piercing members onto the tissue box by use of the top portion; puncturing a bottom surface of the tissue box with the piercing members; and lifting tissues toward a top surface of the tissue box by use of a plurality of lifting members of the lifting device.

The foregoing and other features and advantages of the present invention will be apparent from the following more detailed description of the particular embodiments of the invention, as illustrated in the accompanying drawings.

BRIEF DESCRIPTION OF THE DRAWINGS

The invention will hereinafter be described in conjunction with the appended drawings where like designations denote like elements, and.

DETAILED DESCRIPTION OF EMBODIMENTS OF THE INVENTION

As discussed above, embodiments of the present invention relate to a tissue box cover with a lifting devices adapted to lift tissue within a tissue box. Generally, the present invention includes a tissue box cover having a top and bottom portion and a lifting device having piercing members and lifting members.

Figure 1A:
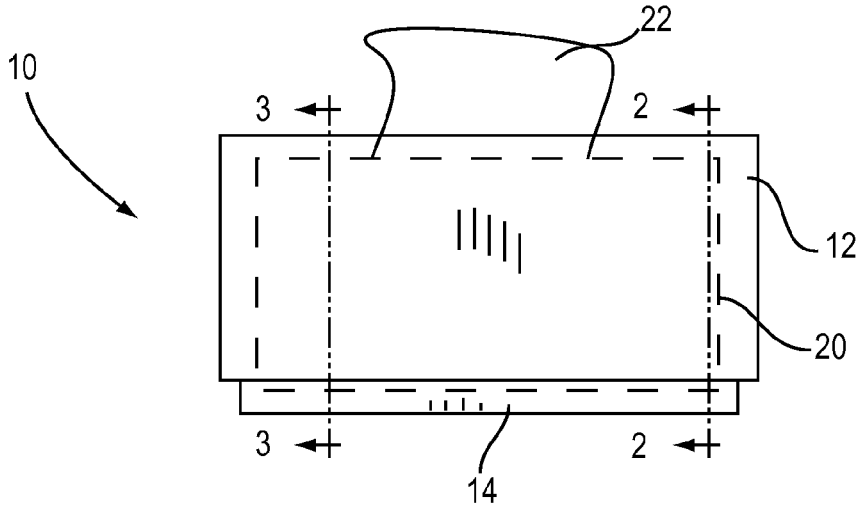
FIG. 1A is a side view of a tissue box cover in accordance with the present invention.
Figure 1B:
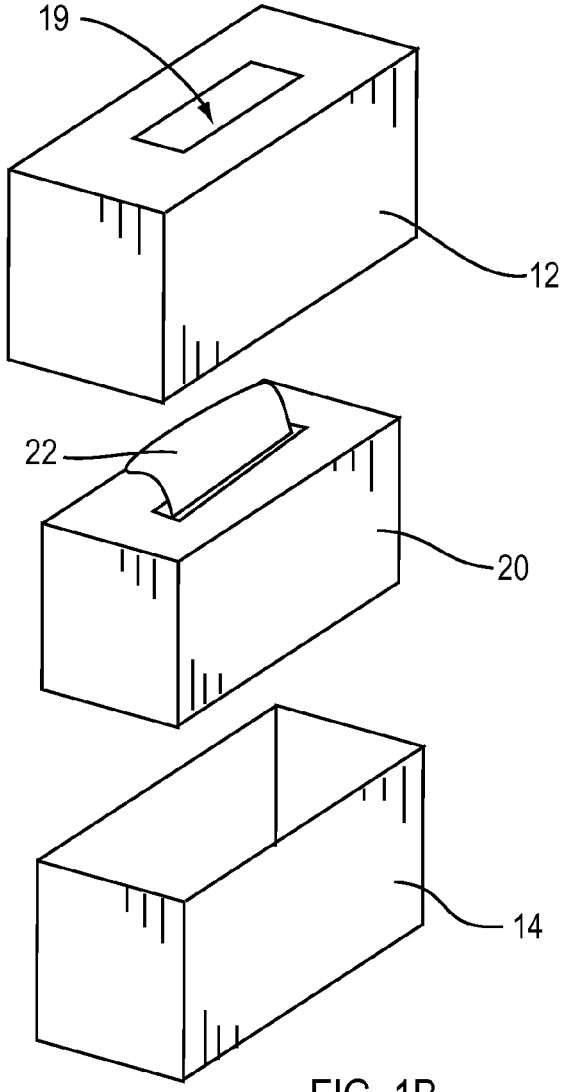
FIG. 1B is an exploded perspective view of the tissue box cover of FIG. 1A.

Referring to the drawings, FIGS. 1A and 1B depict a tissue box cover 10 in accordance with embodiments of the present invention. The box cover 10 may include a top portion 12, and a bottom portion 14. The top portion 12 may include an aperture 19 for receiving tissues 22 of a tissue box 20 there through. The bottom portion 14 is adapted to receive the tissue box 20 and the top portion is adapted to cover the tissue box and to repeatably, removably couple to the bottom portion 14.

Figure 2:
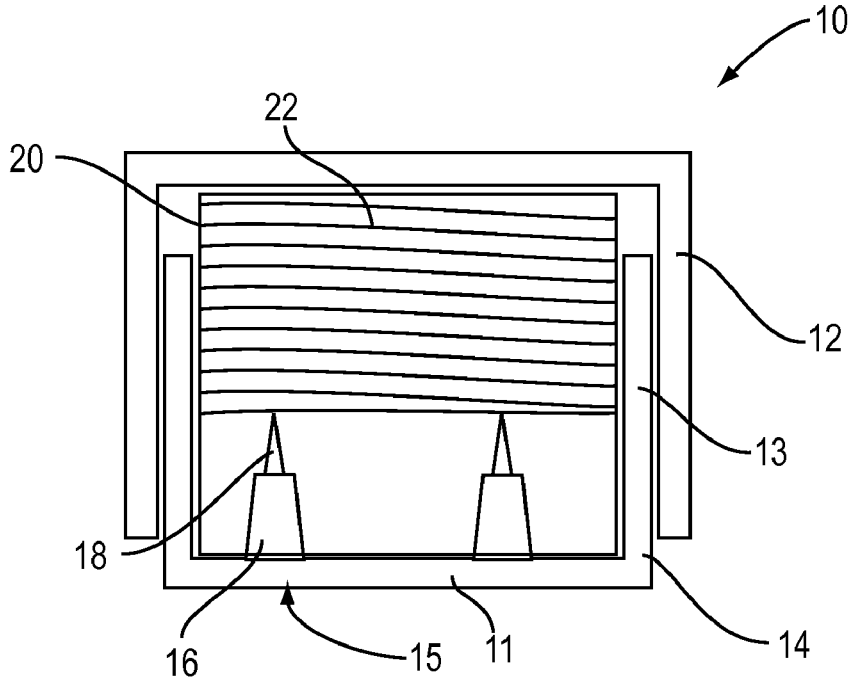
FIG. 2 is section view of a tissue box cover taken along line 2-2 of FIG. 1A.
Figure 3:
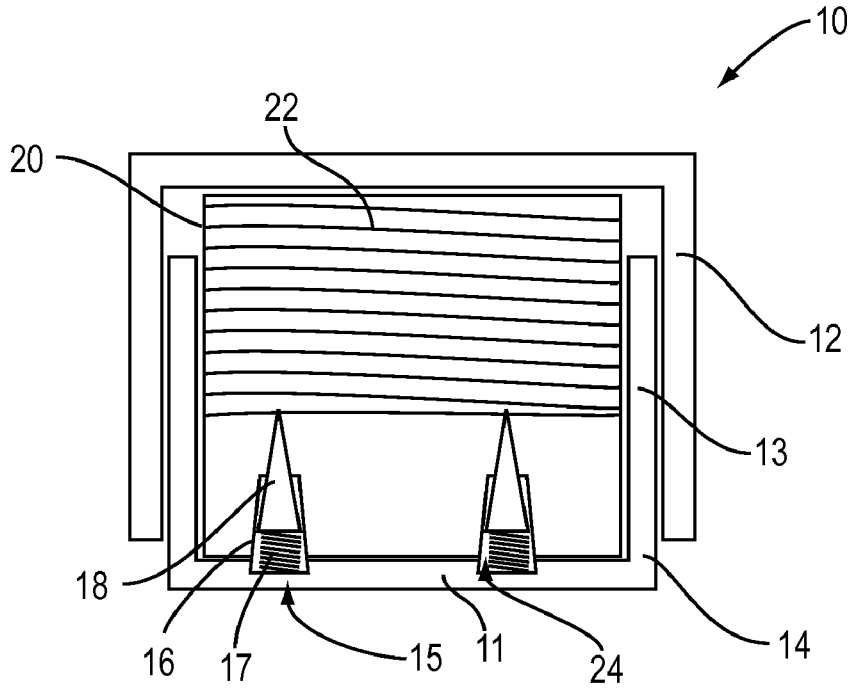
FIG. 3 is section view of a tissue box cover taken along line 3-3 of FIG. 1A.

With further reference to the drawings, FIGS. 2 and 3 depict section view of the tissue box cover 10. The bottom portion 14 may include a base 11 and four side walls 13. The base 11 may include a lifting device 15. The lifting device may include a plurality of piercing members 16 coupled to the base and a plurality of lifting members 18. The piercing members 16 may be adapted to puncture a hole in a bottom surface of the tissue box 20. The plurality of lifting members 18 correspond to the plurality of piercing members 16. Each of the plurality of lifting members 18 may have a resilient member 17 that biases tissues 22 within the tissue box 20 toward a top surface of the tissue box 20. The resilient member 17 may be a spring.

According to particular embodiments, the plurality of piercing members 16 of the lifting device 15 are adapted to puncture a hole in the bottom surface of the tissue box 20 in response to a force applied to the tissue box 20 by the top portion 12 in a direction towards the piercing members 16. It will be understood that force may be applied to the tissue box 20 without the use of the top portion 12 of the tissue box cover 10.

Figure 8A:
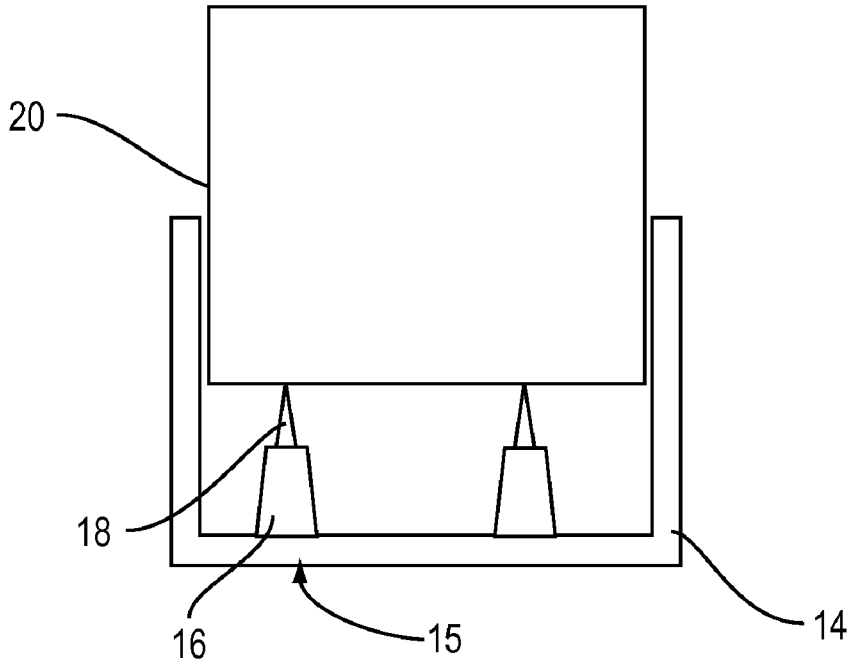
FIGS. 8A-8B are section views of a bottom portion of a tissue box cover with the lifting members in respective retracted positions and extended positions.
Figure 8B:
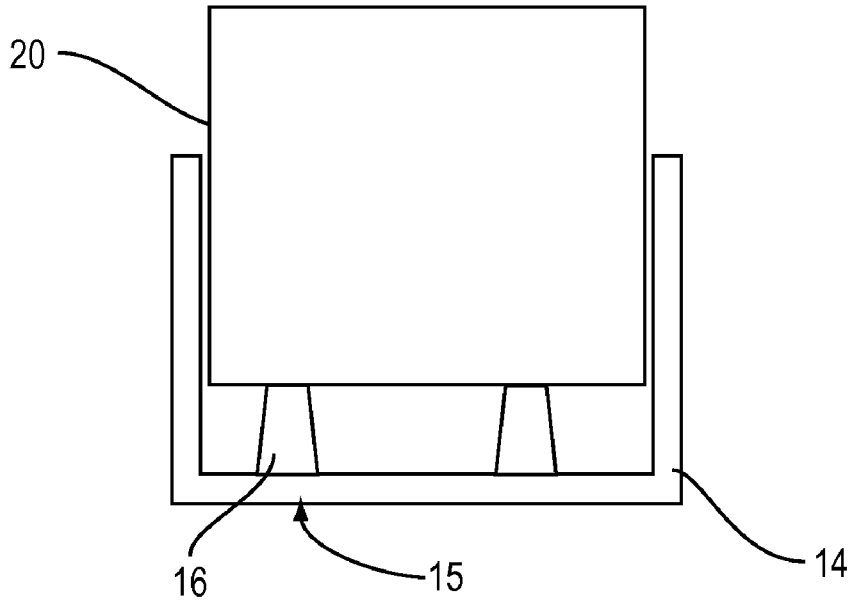

Further, the plurality of piercing members 16 may comprise a frustoconical shape having a recess 24. Each of the plurality of lifting members 18 may be moveably coupled within the recess 24 of each of the corresponding plurality of piercing members 16. The resilient members 17 are adapted to allow each of the plurality of lifting members 18 to move between a retracted position (as shown in FIG. 8A) and an extended position (as shown in FIG. 8B). In the retracted position the lifting member 18 is within the recess 24 of the corresponding piercing member 16. In the extended position is in a direction away from the recess 24 and toward the top surface of the tissue box 20.

According to particular embodiments of the present invention, the plurality of lifting members 18 may be moved into the retracted position in response to the force applied to the tissue box 20 by the top portion 12 in a direction towards the piercing members 16, as shown in FIG. 8A.

As can be seen in FIGS. 2 and 3, as the lifting members move in the extended position, they engage the tissues 22 within the tissue box 20. This engagement and the force generated by the resilient members 17 apply force to the tissue in a direction toward the top surface of the tissue box 20. This force results in the lifting of the tissues. As the weight of the tissue lowers in response to tissues being used, the resilient member force the lifting members 18 further toward the top surface of the tissue box 20. Therefore, the lifting members 18 are adapted to bias the tissues 22 toward the top surface of the tissue box 20. This provides the benefit of having the tissues near the aperture 19 of the top portion 12 of the tissue box cover 10 at all times, rendering it easier to obtain a tissue 22 from the tissue box 20.

Figure 4:
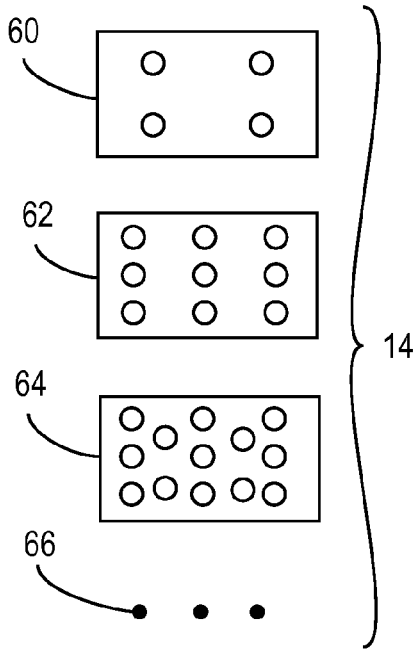
FIG. 4 is a top view of various configurations of a bottom portion of the tissue box cover with a lifting device.

Referring further to the drawings, FIG. 4 depicts various configurations of the bottom portion 14 of the tissue box cover 10. These configurations may include various placements of the piercing devices and the lifting devices as shown in configurations 60, 62 and 64. Additionally, any number of various configurations 66 may be used so long as it operates to lift tissues in a tissue box.

Figure 5:
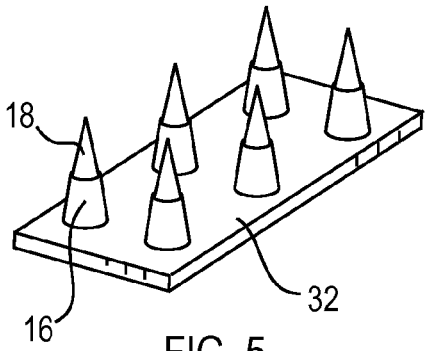
FIG. 5 is a perspective view of a lifting device in accordance with the present invention.
Figure 6:
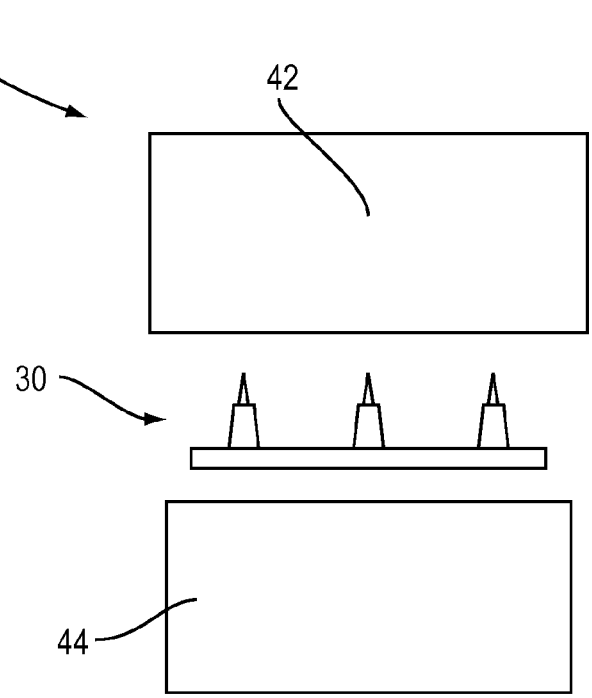
FIG. 6 is an exploded side view of a lifting device for use in tissue box cover not already having a lifting device.

FIGS. 5 and 6 show a lifting device 30 according to particular embodiments of the present invention. The lifting device may include a plurality of piercing members 16 coupled to the base 32 and a plurality of lifting members 18. The piercing members 16 may be adapted to puncture a hole in a bottom surface of a tissue box. The plurality of lifting members 18 correspond to the plurality of piercing members 16. Similar to the piercing members 16 and the lifting members 18 shown in FIG. 3, each of the plurality of lifting members 18 may have a resilient member 17 that biases tissues within the tissue box toward a top surface of the tissue box. The resilient member 17 may be a spring.

According to particular embodiments, the plurality of piercing members 16 of the lifting device 30 are adapted to puncture a hole in the bottom surface of the tissue box in response to a force applied to the tissue box in a direction towards the piercing members 16.

Further, similar to FIG. 3, the plurality of piercing members 16 may comprise a frustoconical shape having a recess 24. Each of the plurality of lifting members 18 may be moveably coupled within the recess 24 of each of the corresponding plurality of piercing members 16. The resilient members 17 are adapted to allow each of the plurality of lifting members 18 to move between a retracted position similar to that shown in FIG. 8A and an extended position similar to that shown in FIG. 8B. In the retracted position the lifting member 18 is within the recess 24 of the corresponding piercing member 16. In the extended position is in a direction away from the recess 24 and toward the top surface of the tissue box 20.

According to particular embodiments of the present invention, the plurality of lifting members 18 may be moved into the retracted position in response to the force applied to the tissue box in a direction towards the piercing members 16.

As shown in FIG. 6, the lifting device 30 may be coupled to a tissue box cover 40 having a top portion 42 and a bottom 44, wherein the box cover 40 does not have an integral lifting device. In this combination, the lifting device may operate according to the operation of the tissue box cover with a lifting device as discussed above. Particularly, as the lifting members 18 move in the extended position, they engage the tissues within a tissue box. This engagement and the force generated by the resilient members 17 apply force to the tissue in a direction toward the top surface of the tissue box. This force results in the lifting of the tissues. As the weight of the tissue lowers in response to tissues being used, the resilient members 17 force the lifting members 18 further toward the top surface of the tissue box. Therefore, the lifting members 18 are adapted to bias the tissues toward the top surface of the tissue box. This provides the benefit of having the tissues near an aperture of the top portion 42 of the tissue box cover 40 at all times, rendering it easier to obtain a tissue 22 from the tissue box 20.

Figure 7:
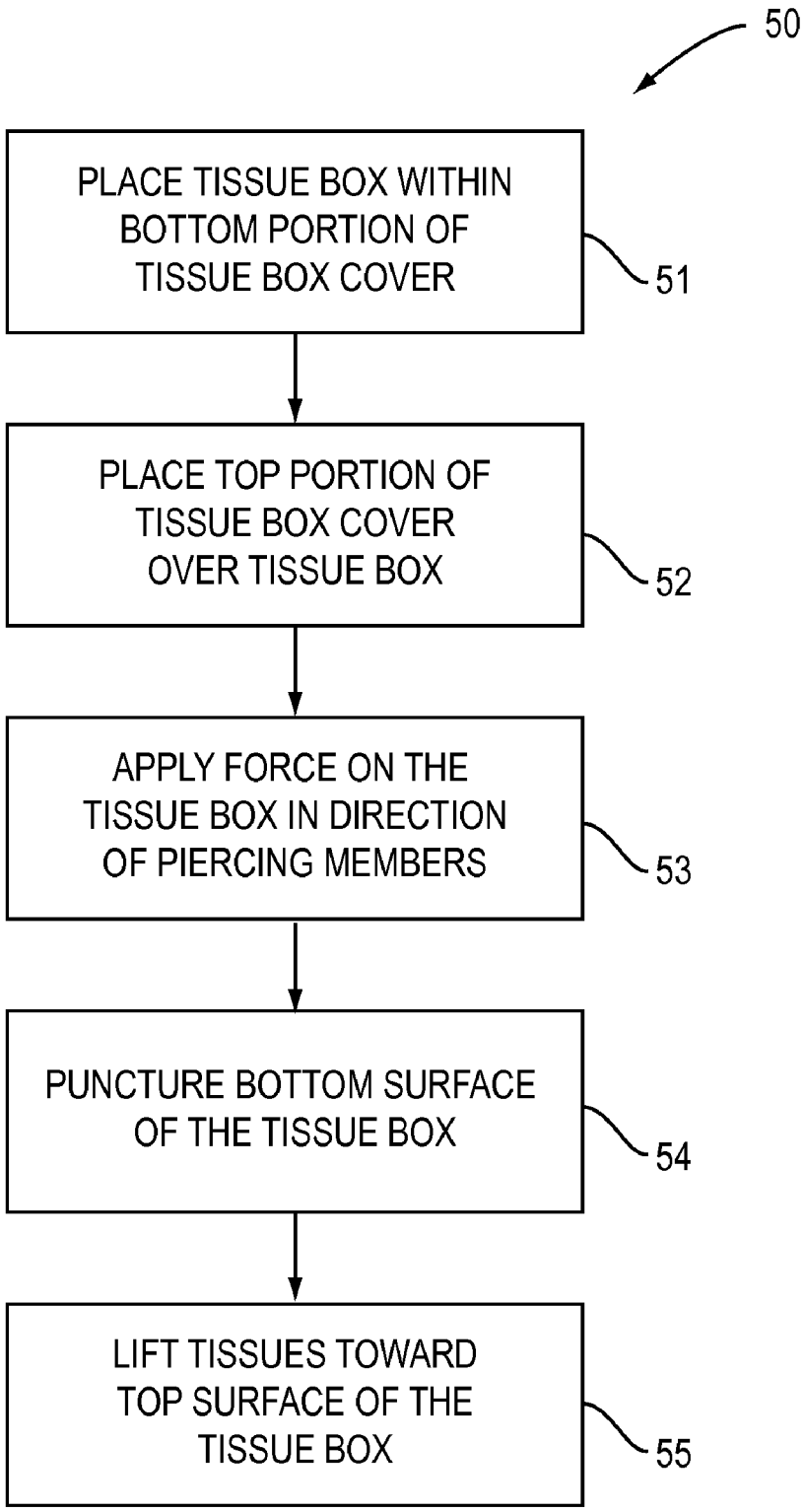
FIG. 7 is a flow chart of a method of using a tissue box cover with a tissue lifting device.

According to another embodiment of the present invention, FIG. 7 depicts a method 50 of using a tissue box with a lifting device. The method 50 may include the steps of placing a tissue box within a bottom portion of the tissue box cover (Step 51), wherein the tissue box is adjacent a piercing members of a lifting device coupled to a base of the tissue box cover; placing a top portion of the tissue box cover over the tissue box (Step 52); applying force onto the tissue box in the direction of the piercing members by use of the top portion (Step 53); puncturing a bottom surface of the tissue box with the piercing members (Step 54); and lifting tissues toward a top surface of the tissue box by use of a plurality of lifting members of the lifting device (Step 55). Step 53 may further include the step of moving the plurality of lifting members from an extended position to a retracted position.

According to particular embodiments, the method 50 may further include the steps of removing the top portion from the bottom portion when the tissue box is empty and removing the tissue box from the bottom portion.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims. Accordingly, any components of the present invention indicated in the drawings or herein are given as an example of possible components and not as a limitation.

Accordingly, for the exemplary purposes of this disclosure, the components defining any embodiment of the invention may be formed as one piece if it is possible for the components to still serve their function. The components may also be composed of any of many different types of materials or combinations thereof that can readily be formed into shaped objects provided that the components selected are consistent with the intended mechanical operation of the invention. For example, the components may be formed of rubbers (synthetic and/or natural), glasses, composites such as fiberglass, carbon-fiber and/or other like materials, polymers such as plastic, polycarbonate, PVC plastic, ABS plastic, polystyrene, polypropylene, acrylic, nylon, phenolic, any combination thereof, and/or other like materials, metals, such as zinc, magnesium, titanium, copper, iron, steel, stainless steel, any combination thereof, and/or other like materials, alloys, such as aluminum, and/or other like materials, any other suitable material, and/or any combination thereof.

The invention claimed is:

1. A lifting device for use in a tissue box cover for lifting tissues in a box, the device comprising:

a base;

a plurality of piercing members coupled to the base, the piercing members adapted to puncture a hole in a bottom surface of a tissue box, wherein the plurality of piercing members are adapted to puncture a hole in the bottom surface of the tissue box in response to a force applied to the tissue box in a direction towards the piercing members and wherein each of the plurality of piercing members comprises a frustoconical shape having a recess; and a plurality of lifting members corresponding to the plurality of piercing members, each of the plurality of lifting members having a resilient member that biases tissues within the tissue box toward a top surface of the tissue box, wherein each of the plurality of lifting members are moveably coupled within the recess of each of the corresponding plurality of piercing members.

2. The device of claim 1, wherein the resilient members are adapted to allow each of the plurality of lifting members to move between a retracted position and an extended position, wherein the retracted position is within the recess of each of the plurality of piercing members, and the extended position is in a direction way from the recess and toward the top surface of the tissue box.

3. The device of claim 2, wherein the plurality of lifting members are moved into the retracted position in response to the force applied to the tissue box in a direction towards the piercing members.

4. The device of claim 1, wherein the resilient members of the plurality of lifting members are further adapted to force the lifting members further toward the top surface of the tissue box in response to reducing the weight of the tissue by use of the tissues.

5. A tissue box cover with an integral tissue lifting device, the tissue box comprising:

a bottom portion having a base and four side members defining an opening for receiving a tissue box, the base having a lifting device comprising:

a plurality of piercing members coupled to the base, the piercing members adapted to puncture a hole in a bottom surface of the tissue box, wherein the plurality of piercing members of the lifting device are adapted to puncture a hole in the bottom surface of the tissue box in response to a force applied to the tissue box by the top portion in a direction towards the piercing members and wherein each of the plurality of piercing members comprises a frustoconical shape having a recess; and a plurality of lifting members corresponding to the plurality of piercing members, each of the plurality of lifting members having a resilient member that biases tissues within the tissue box toward a top surface of the tissue box, wherein teach the plurality of lifting members are moveably coupled within the recess of each of the corresponding plurality of piercing members; and a top portion adapted to repeatably, removably couple to the bottom portion of the tissue box.

6. The tissue box cover of claim 5, wherein the resilient members are adapted to allow each of the plurality of lifting members to move between a retracted position and an extended position, wherein the retracted position is within the recess of each of the plurality of piercing members, and the extended position is in a direction way from the recess and toward the top surface of the tissue box.

7. The tissue box cover of claim 6, wherein the plurality of lifting members are moved into the retracted position in response to the force applied to the tissue box by the top portion in a direction towards the piercing members.

8. The tissue box cover of claim 5, wherein the resilient members of the plurality of lifting members are further adapted to force the lifting members further toward the top surface of the tissue box in response to reducing the weight of the tissue by use of the tissues.

9. A method of using a tissue box cover with a lifting device, the method comprising:

placing a tissue box within a bottom portion of the tissue box cover, wherein the tissue box is adjacent a piercing members of a lifting device coupled to a base of the tissue box cover, wherein the piercing members of the lifting device are adapted to puncture a hole in the bottom surface of the tissue box in response to a force applied to the tissue box by the top portion in a direction towards the piercing members and wherein the piercing members comprise a frustoconical shape having a recess;

placing a top portion of the tissue box cover over the tissue box;

applying force onto the tissue box in the direction of the piercing members by use of the top portion;

puncturing a bottom surface of the tissue box with the piercing members; and lifting tissues toward a top surface of the tissue box by use of a plurality of lifting members of the lifting device, wherein each the plurality of lifting members are moveably coupled within the recess of each of the corresponding piercing members.

10. The method of claim 9, wherein applying force in the direction of the piercing members results in moving the plurality of lifting members from an extended position to a retracted position.

11. The method of claim 9, further comprising removing the top portion from the bottom portion when the tissue box is empty.

12. The method of claim 11, further comprising removing the tissue box from the bottom portion.

* * * * *